US006568116B2

(12) United States Patent
Hathaway

(10) Patent No.: US 6,568,116 B2
(45) Date of Patent: May 27, 2003

(54) FIREARM SAFE GUNS SECURITY CONTACT

(76) Inventor: Ronald Lloyd Hathaway, 4428 Cunningham, Wichita Falls, TX (US) 76301

( * ) Notice: Subject to any disclaimer, the term of this patent is extended or adjusted under 35 U.S.C. 154(b) by 0 days.

(21) Appl. No.: 09/727,053

(22) Filed: Apr. 4, 2001

(65) Prior Publication Data

US 2002/0144447 A1 Oct. 10, 2002

(51) Int. Cl.[7] ..... F41A 17/00

(52) U.S. Cl. ..... 42/70.11; 42/70.01; 42/70.06; 42/94; 42/70.07; 70/57.1; 211/64

(58) Field of Search ..... 42/70.01, 70.11, 42/70.06, 70.99, 94, 70.07; 70/57.1; 211/64; 224/149, 198, 238, 243, 911, 912; 701/57.1

(56) References Cited

U.S. PATENT DOCUMENTS 3,343,411 A * 9/1967 Lee ..... 42/70.01
4,198,026 A * 4/1980 Capolupo
4,299,045 A * 11/1981 Cervantes ..... 42/70.07
4,367,811 A * 1/1983 Yoneda et al. ..... 42/70.11
4,689,908 A * 9/1987 McClellan ..... 42/70.11
4,819,359 A * 4/1989 Bassett ..... 42/94
5,283,971 A * 2/1994 Fuller et al. ..... 42/70.11
5,416,472 A * 5/1995 Torii, Jr.
5,598,151 A * 1/1997 Torii, Jr.
5,621,996 A * 4/1997 Mowl, Jr. ..... 42/70.121
5,916,087 A * 6/1999 Owens
5,937,559 A * 8/1999 Jennen ..... 42/94
6,134,822 A * 10/2000 Murgel ..... 42/70.07
6,223,461 B1 * 5/2001 Mardirossian ..... 42/70.11
6,301,815 B1 * 10/2001 Sliwa ..... 42/70.11
6,408,905 B1 * 6/2002 Lee ..... 42/70.01

FOREIGN PATENT DOCUMENTS

NL 387867 A * 8/1923

* cited by examiner

*Primary Examiner*—Michael Carone
*Assistant Examiner*—Lulit Semunegus
(74) *Attorney, Agent, or Firm*—Grady K. Bergen

(57) ABSTRACT

A security mount and system for protecting a firearm. The base of the firearm is placed in a receptacle in the mount to hold the firearm. A switch in the bottom of the receptacle is activated when the firearm is removed from the mount. The mount may be connected directly to an alarm or to a premises security system which sounds the alarm when the switch is activated. The premises security system may also report an alarm condition to a monitoring center via a wireline connection or a wireless link when the switch is activated.

17 Claims, 2 Drawing Sheets

FIREARM SAFE GUNS SECURITY CONTACT

BACKGROUND OF THE INVENTION

1. Technical Field of the Invention

This invention relates to security systems and, more particularly, to a security system and mount for a firearm that prevents the firearm from being removed from the mount and/or sounds an alarm if the firearm is moved.

2. Description of Related Art

Many people keep firearms in their homes and/or businesses for protection against uninvited intruders. Many others have firearms in their homes that they use for hunting or sport shooting. Every year, however, people are tragically injured or killed in firearm accidents. Unfortunately, it is oftentimes children who are injured or killed when they find their parent's firearm and decide to play with it. It would be advantageous to have a security system and mount for a firearm that prevents the firearm from being removed from the mount and/or sounds an alarm if the firearm is moved. Such a system and firearm mount could save many lives.

Gun shops and pawn shops that carry firearms could also benefit from such a system and firearm mount. The present invention provides such a system and firearm mount.

SUMMARY OF THE INVENTION

In one aspect, the present invention is a security mount for a firearm that includes an upright wall configuration forming a receptacle for receiving the base of the firearm; a switch in the receptacle that is activated when the base of the firearm is removed from the receptacle; and means connected to the switch for sounding an alarm when the switch is activated. The base of the firearm may include a magnet mounted thereon, and the switch may be a magnetic switch that is activated by a magnetic field generated by the magnet. The switch may also be a mechanical switch that is activated when the base of the firearm breaks contact with the switch.

In another aspect, the present invention is a security mount for a firearm having a base, a trigger, and a trigger guard surrounding the trigger. The mount includes an upright wall configuration forming a receptacle for receiving the base of the firearm; a switch in the receptacle that is activated when the base of the firearm is partially removed from the receptacle; and means connected to the switch for sounding an alarm when the switch is activated. The wall configuration also includes an archway located in a position in which the trigger guard extends through a slot in the archway when the base of the firearm is inserted into the receptacle. A locking mechanism in the archway extends through the trigger guard, thereby preventing the firearm from being removed from the mount.

In yet another aspect, the present invention is a security system for protecting a firearm. The system includes a security mount for holding the firearm, the mount including a switch that is activated when the firearm is removed from the mount. The system also includes means connected to the switch for sounding an alarm when the switch is activated. The means for sounding an alarm may include a premises security system connected to the switch. The premises security system may activate a local alarm, or may report an alarm condition to a monitoring center via a wireline connection or a wireless link when the switch is activated.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
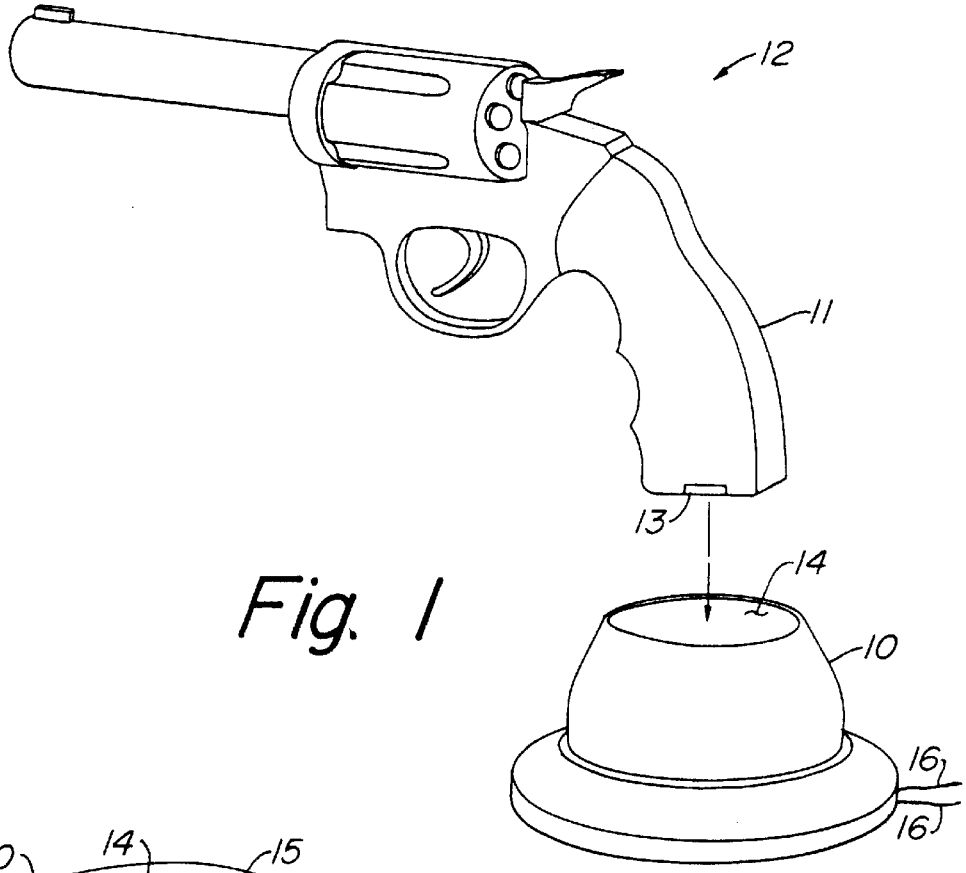
FIG. 1 is a side elevational view of a first embodiment of the firearm mount of the present invention suitable for use in homes without children.

FIG. 1 is a side elevational view of a first embodiment of the firearm mount 10 of the present invention suitable for use in homes without children. The base 11 of a firearm 12 is equipped with a magnet 13 and is placed into a receptacle 14 in the mount. The base fits snugly into the receptacle, thus holding the firearm in a vertical position. In this embodiment, the firearm can be physically removed from the mount in a rapid manner when necessary by merely lifting the base of the firearm out of the receptacle.

Figure 2:
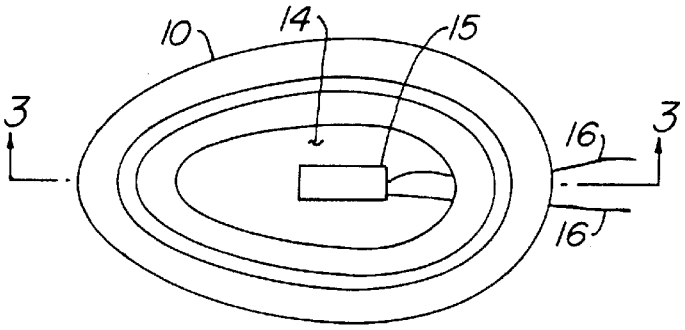
FIG. 2 is a top plan view of the firearm mount of FIG. 1.

FIG. 2 is a top plan view of the firearm mount 10 of FIG. 1. Within the mount, at the bottom of the receptacle 14, is mounted a switch 15. In the preferred embodiment, the switch is a magnetic switch. When the base 11 of the firearm 12 is placed within the receptacle, the switch is closed by the magnet 13. Thereafter, the mount is "armed". If the firearm is then removed from the mount, the magnet is pulled away from the magnetic switch, and the switch opens due to the magnetic field of the magnet. If the system is activated, this sends a signal over connecting wires 16 to a controller, as described in further detail below, which activates an alarm. The alarm may be audible, visual, tactile, or any other suitable means for alerting the user/owner of the firearm that an unauthorized person has removed the firearm from the mount.

In an alternative embodiment, the switch 15 is a mechanical switch, and the weight of the firearm is sufficient to close the switch. If the firearm is then removed from the mount, the mechanical switch opens. Once again, this sends a signal to the controller which activates the alarm. In this embodiment, no magnet is required in the base of the firearm. It should also be noted that the mount can be connected directly to the alarm without an intervening controller.

Figure 3:
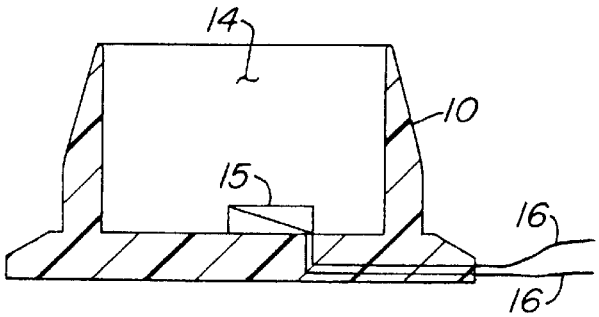
FIG. 3 is a cross-sectional view of the firearm mount of FIG. 1 taken along line 3—3 of FIG. 2.

FIG. 3 is a cross-sectional view of the firearm mount 10 of FIG. 1 taken along line 3—3 of FIG. 2. In this view, the positioning of the switch 15 at the bottom of the receptacle 14 can be seen. The mount is shown as being constructed of a plastic material, but it should be recognized that the mount may be constructed of other suitably rigid materials such as, for example metal, ceramic, glass or wood.

Figure 4:
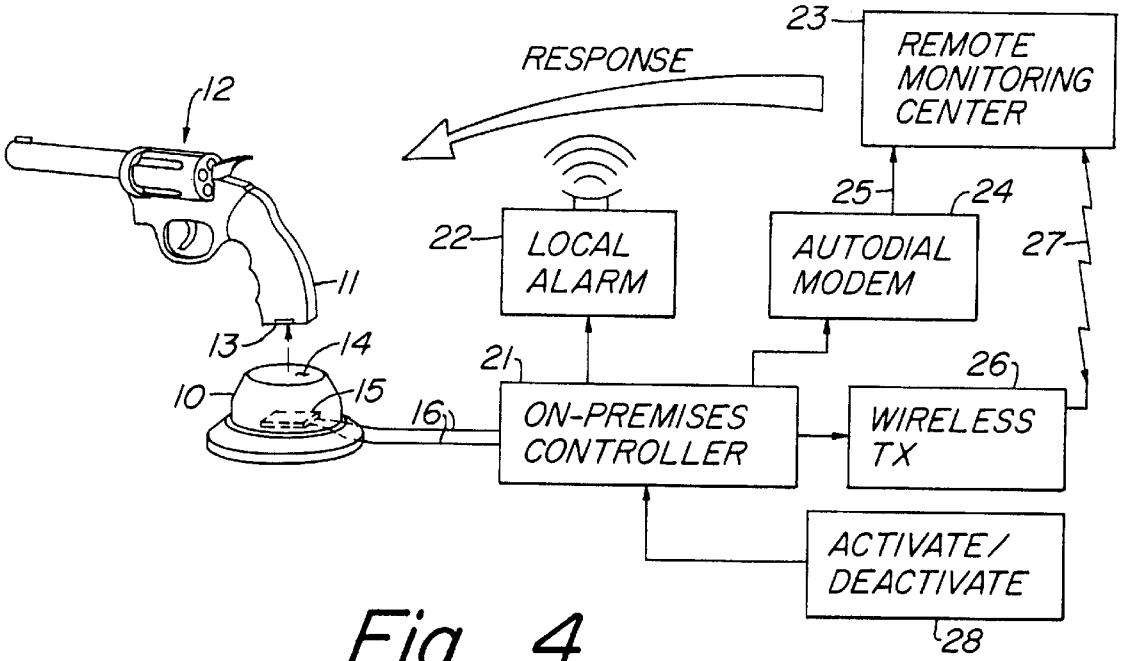
FIG. 4 is a simplified block diagram of the firearm security system of the present invention.

FIG. 4 is a simplified block diagram of the firearm security system of the present invention. As noted above, placing the base 11 of the firearm 12 into the receptacle 14 arms the mount 10. If the firearm is then removed from the mount, the switch 15 opens. If the system is activated, this sends a signal to the On-Premises Controller 21. The Controller may activate a local alarm 22, send a message to a Remote Monitoring Center 23, or both. Typically, an on-premises security system may be equipped with an Autodial Modem 24 that automatically dials the telephone number of the Remote Monitoring Center when an alarm condition is detected. The alarm message is then sent over wireline telephone lines 25 to the Remote Monitoring Center. The system may also be equipped with a Wireless Transmitter (TX) 26 that sends a Radio Frequency (RF) signal 27 to the Remote Monitoring Center when an alarm condition is detected. The system also includes an Activation/Deactivation Mechanism 28 that notifies the Controller when the user has activated the system and when the user has deactivated the system. When the system is deactivated, the firearm can be removed from the mount without creating an alarm condition. Deactivation may require the user to enter a code number.

Figure 5:
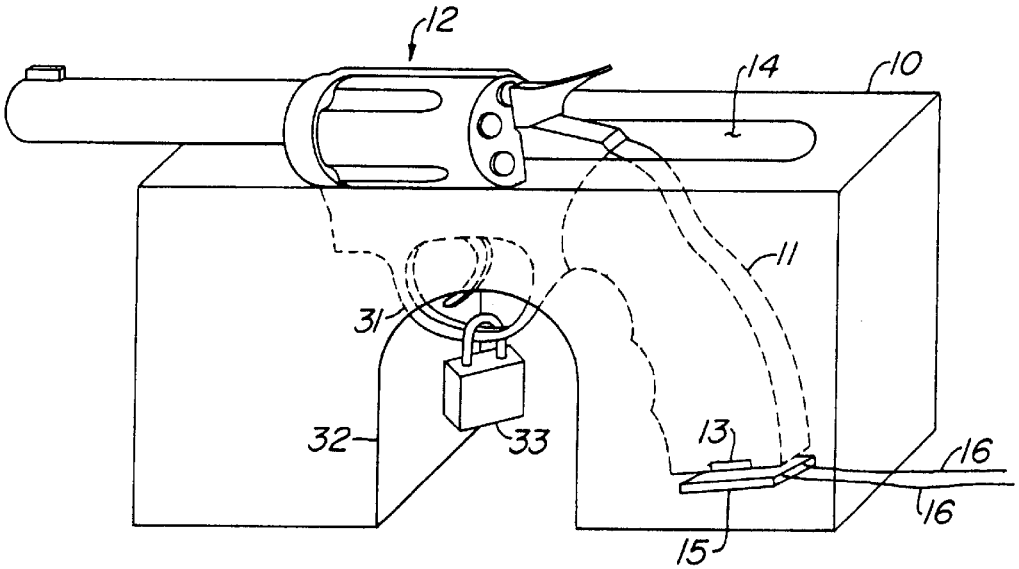
FIG. 5 is a side elevational view of a second embodiment of the firearm mount of the present invention suitable for use in homes with children.

FIG. 5 is a side elevational view of a second embodiment of the firearm mount of the present invention suitable for use in homes with children. Once again, the base 11 of the firearm 12 is placed within the receptacle 14. When the base of the firearm is fully seated within the receptacle, the trigger guard 31 of the firearm extends through a narrow slot (not shown) in the top of an archway 32 formed at the base of the mount, in front of the receptacle. The trigger itself is still concealed within the mount. A padlock 33 is then placed through the trigger guard and locked. Since the padlock is too wide to fit through the narrow slot in the archway, the firearm cannot be physically removed from the mount.

When the base 11 of the firearm 12 is fully seated within the receptacle 14, the switch 15 is closed, thus arming the mount. If someone such as a child attempts to pull the firearm out of the mount, the firearm may move enough to open the switch 15. The alarm is then activated even though the firearm cannot be physically removed from the mount, and the child cannot gain access to the trigger.

Several additional features of the mount 10 should also be noted. First, in either embodiment, the use of an enclosed receptacle with a switch at the bottom prevents tampering by any individual who would attempt to remove the firearm without triggering the alarm. For example, when a magnetic switch is utilized, it is not possible to insert a substitute magnet adjacent to the switch 15 and then remove the firearm undetected. Second, the mount may be utilized both with handguns, as illustrated, or with rifles or shotguns. For example, one or more mounts may be mounted side-by-side on a horizontal tray at the base of a vertical gun rack. The butts of rifles and shotguns can then be placed in the mounts with the rifles and shotguns mounted vertically in the gun rack. For horizontal gun racks, the mounts can be mounted on a vertical side of the gun rack so that the butts of the rifles and shotguns can then be placed in the mounts with the rifles and shotguns mounted horizontally in the gun rack.

It is thus believed that the operation and construction of the present invention will be apparent from the foregoing description. While the security mount and system shown and described has been characterized as being preferred, it will be readily apparent that various changes and modifications could be made therein without departing from the scope of the invention as defined in the following claims.

What is claimed is:

1. A security mount for a firearm having a base, said mount comprising:

an upright wall configuration forming a receptacle for receiving the base of the firearm, wherein the receptacle is an enclosed receptacle;

a switch in the receptacle that is activated when the base of the firearm is removed from the receptacle, the switch being in a position within the receptacle such that the switch is inaccessible when the base of the firearm is positioned within the receptacle; and means connected to the switch for activating an alarm when the switch is activated.

2. The security mount for a firearm of claim 1 wherein the base of the firearm includes a magnet mounted thereon, and the switch is a magnetic switch that is activated by a magnetic field generated by the magnet.

3. The security mount for a firearm of claim 1 wherein the switch is a mechanical switch that is activated when the base of the firearm breaks contact with the switch.

4. The security mount for a firearm of claim 1 wherein the upright wall configuration forms a receptacle having dimensions approximately equal to the base of the firearm so that the firearm is held by the receptacle in an upright position when the base of the firearm is inserted into the receptacle.

5. The security mount for a firearm of claim 1 wherein the means for activating an alarm includes a local alarm selected from the group consisting of an audible alarm, a visual alarm, and a tactile alarm.

6. The security mount for a firearm of claim 5 wherein the means for activating an alarm includes a connection from the switch to a premises security system that activates the local alarm.

7. The security mount for a firearm of claim 1 wherein the means for activating an alarm includes a connection from the switch to a premises security system that sends an alarm indication to a monitoring center.

8. A security system for protecting a firearm comprising:

a security mount for holding the firearm, said mount including a switch that is activated when the firearm is removed from the mount, the switch being in a position on the mount such that the switch is inaccessible when the base of the firearm is held by the mount, wherein the mount includes a receptacle for closely receiving the base of the firearm so that the firearm is held within the receptacle in an upright manner without additional support; and means connected to the switch for activating an alarm when the switch is activated.

9. The security system of claim 8 wherein the means for activating an alarm includes a premises security system connected to the switch, the premises security system activating a local alarm.

10. The security system of claim 8 wherein the means for activating an alarm includes:

a monitoring center that responds to reported alarm conditions; and a premises security system connected to the switch, the premises security system including transmission means for reporting an alarm condition to the monitoring center when the switch is activated.

11. The security system of claim 10 wherein the transmission means includes an autodial modem that automatically dials a telephone number of the monitoring center when the switch is activated.

12. The security system of claim 11 wherein the transmission means reports the alarm condition over wireline telephone lines to the monitoring center when the switch is activated.

13. The security system of claim 11 wherein the transmission means includes a wireless transmitter that reports the alarm condition over a wireless link to the monitoring center when the switch is activated.

14. The security system of claim 8 further comprising an activation/deactivation mechanism that enables a user to activate or deactivate the system.

15. The security system of claim 14 wherein the means for activating an alarm sounds the alarm only when the user has activated the system using the activation/deactivation mechanism.

16. A security mount for a firearm having a base, a trigger, and a trigger guard surrounding the trigger, said mount comprising:

an upright wall configuration forming a receptacle for receiving the base of the firearm, said wall configuration also having an archway located in a position in which the trigger guard extends through a slot in the archway when the base of the firearm is inserted into the receptacle;

a switch in the receptacle that is activated when the base of the firearm is partially removed from the receptacle;

means connected to the switch for activating an alarm when the switch is activated; and a locking mechanism in the archway that extends through the trigger guard, thereby preventing the firearm from being removed from the mount, and wherein the archway is dimensioned so that the trigger guard extends through the slot in the archway when the base of the firearm is inserted into the receptacle, while the trigger remains inaccessible within the wall configuration.

17. The security mount for a firearm of claim 16 wherein the locking mechanism is a padlock that is larger than the slot in the archway, thereby preventing the firearm from being removed from the mount.

* * * * *